US008043202B2

(12) United States Patent
Lehnhaeuser

(10) Patent No.: US 8,043,202 B2
(45) Date of Patent: Oct. 25, 2011

(54) DEVICE AND METHOD FOR THERMOTHERAPY

(75) Inventor: Frank Lehnhaeuser, Hoehn (DE)

(73) Assignee: HiServ Gebaeudedienstleistungen GmbH, Giessen (DE)

( * ) Notice: Subject to any disclaimer, the term of this patent is extended or adjusted under 35 U.S.C. 154(b) by 1490 days.

(21) Appl. No.: 10/597,452

(22) PCT Filed: Jan. 26, 2005

(86) PCT No.: PCT/EP2005/000753

§ 371 (c)(1),
(2), (4) Date: Jul. 26, 2006

(87) PCT Pub. No.: WO2005/070364

PCT Pub. Date: Aug. 4, 2005

(65) Prior Publication Data

US 2008/0234538 A1 Sep. 25, 2008

(30) Foreign Application Priority Data

Jan. 26, 2004 (DE) ..... 10 2004 003 955
Mar. 30, 2004 (DE) ..... 10 2004 016 080

(51) Int. Cl.
*A61G 11/00* (2006.01)

(52) U.S. Cl. ..... 600/22; 600/21

(58) Field of Classification Search ..... 607/81–87; 600/21, 22

See application file for complete search history.

(56) References Cited

U.S. PATENT DOCUMENTS

| | | | | |
|---|---|---|---|---|
| 5,759,149 | A * | 6/1998 | Goldberg et al. | 600/22 |
| 5,817,002 | A * | 10/1998 | Donnelly et al. | 600/22 |
| 6,270,452 | B1 * | 8/2001 | Donnelly et al. | 600/22 |
| 6,296,606 | B1 * | 10/2001 | Goldberg et al. | 600/22 |
| 6,746,394 | B2 | 6/2004 | Donnelly et al. | |
| 2004/0224626 | A1 * | 11/2004 | Koch et al. | 454/189 |

FOREIGN PATENT DOCUMENTS

| | | | |
|---|---|---|---|
| DE | 103 20 195.5 | * | 5/2003 |
| EP | 1 247 511 A1 | | 10/2002 |

* cited by examiner

*Primary Examiner* — Ahmed Farah
(74) *Attorney, Agent, or Firm* — Roberts Mlotkowski Safran & Cole, P.C.; David S. Safran

(57) ABSTRACT

A thermotherapy device, in particular for babies, has a lying surface limited by longitudinal sides, a head side and a foot side. The thermotherapy device ensures a simple and safe access of a new-born without producing a detrimental psychological effect on parents. For this purpose, an upwardly oriented feeding device for supplying a hot and humid air is advantageously embodied in three parts, namely, a lateral feed pipe in each longitudinal part and/or a feed pipe in each foot side, a suction device for sucking supplied air is arranged above the lying surface, the suction device is arranged above the head side, in particular above the head area of the lying surface in such a way that the supplied air is sucked only above said head side and/or the head area.

28 Claims, 10 Drawing Sheets

DEVICE AND METHOD FOR THERMOTHERAPY

BACKGROUND OF THE INVENTION

1. Field of the Invention

The invention relates to a thermotherapy device, especially for infants, with a horizontal surface which is bordered by lengthwise sides, a head side and a foot side. Furthermore, this invention relates to a process for thermotherapy using such a thermotherapy device.

2. Description of Related Art

Thermotherapy devices of the initially mentioned type are generally used in the gynecological departments of hospitals for newborns. Existing thermotherapy devices (incubators) have closed, climate-controlled compartments in which a hatch must be opened first to reach the newborn. When a newborn is removed from such a thermotherapy device, it is always necessary to proceed very carefully to avoid injuring the newborn. Another disadvantage of existing incubators is the psychological effect these compartments have on the parents of the newborn.

SUMMARY OF THE INVENTION

The object of this invention is therefore to make available a thermotherapy device of the initially mentioned type in which the above described disadvantages do not occur.

This object is achieved in a thermotherapy device of the initially named type in which there is a, preferably, three-sided supply means for an upwardly directed supply of warm moist air with one side supply being in the area of each of the lengthwise sides and/or a foot supply in the area of the foot side, in which there is an exhaust means for exhausting the supplied air in the horizontal surface, the exhaust means being located above the head side, especially above the head area of the horizontal surface which borders the head side, and the supplied air being exhausted simply above the head side and/or the head area.

According to the process intended to achieve this object, warm moist air is blown out and up, preferably solely from the lengthwise sides and/or the foot side, wherein the supplied air is taken from the top, wherein a given microclimate is formed in the area above the horizontal surface and wherein the air is exhausted simply above the head side and/or a head area which borders the head side.

The configuration in accordance with the invention yields a thermotherapy device in a so-called open version. The microclimate prevailing in the incubator with parameters which are defined, for example, in DIN EN 60601-2-19, is stabilized and bounded by air flows, in contrast to the prior art. The desired microclimate forms within the space bordered by the supplied air jets which are directed upward. The configuration in accordance with the invention has the major advantage that the infant located on a horizontal surface can be quickly and easily accessed. Furthermore, it is possible for the parents of the newborn to directly view and touch him without first having to open a hatch, as is the case in the thermotherapy devices known from the prior art. The adverse psychological effect on the parents of the newborn, as occurs in closed incubators, does not arise in the invention.

Moreover, in conjunction with this invention, it has been established that a microclimate which has been stabilized by flow engineering can be implemented above the horizontal surface by there being simply a three-sided air flow with simultaneous intake above the head side. Therefore, in the region of the head side, air is not supplied; this ultimately reduces the energy demands of the thermotherapy device in accordance with the invention since less inlet air is necessary. However, the lack of air supply in the region of the head side also results in a draft being prevented this region. In any case, it goes without saying that it is also fundamentally possible to provide an air supply on the head side if this is considered necessary, even if the three-sided flow guidance is preferred.

Since there is no inlet air supply on the head side, to prevent the effect of adverse cross flows which can arise due the superimposed room air flows, it is a good idea for there to be a front wall on the head side which extends, preferably, at least essentially over the length of the head side. The front wall thus has a bulkheading action and can, moreover, perform a retaining function for the exhaust means so that the exhaust means is attached to the front wall, and thus, can at least partially extend over the horizontal surface.

In order to obtain a closed air curtain which retains the microclimate, it is advantageous for the side guides to extend at least essentially over the full length of the lengthwise sides. The same also applies to the foot supply. Furthermore, the exhaust means should extend at least essentially over the full length of head side in order to ensure an acquisition region that is as large as possible.

In order to limit access to the horizontal surface by the exhaust means or the base body of the exhaust means as little as possible, it is recommended that the exhaust means extend over the horizontal surface from the head side to over an amount of a maximum ⅔ of the length of the horizontal surface. Here, it goes without saying that, according to this feature, there should fundamentally be an overhang and any value up to an amount of a maximum ⅔ of the length of the horizontal surface is possible, without expressed enumeration of discrete values being necessary.

Research has shown that the outflow direction of the laterally supplied air is dependent on the climatic conditions of the ambient air and the microclimate of the thermotherapy device to be established. Fundamentally, the angle should be larger as the density differences of the out-flowing air to the ambient air become larger. In the extreme case, this can even be 90°. This can lead to different embodiments because, for example, the environment in European hospitals in summer is climate-controlled to roughly 26° C. (78.8° F.), while in the United States, a 20° C. (68° F.) room temperature is maintained. However, basically, it is recommended that the inflow directions of the side supplies and the foot supply have an angle between 10° and 60° with respect to vertical. These slanted inlet air flows yield a type of "flow tent" under which the desired microclimate forms. This "flow tent" can be very small since it is intended for infants. Accordingly, it is recommended that the exhaust means be located a very small distance above the horizontal surface, preferably with a distance which is less than the width of the horizontal surface. This arrangement has the additional advantage that only relative short air curtains need be formed; this is easily and economically possible, with low flow velocities. In any case flow velocities of the supplied air of less than 15 cm/s, preferably of less than 8 to 10 cm/s, can be maintained; here, any flow velocity within a given range being possible without it needing to be specifically mentioned.

In order to be able to easily adapt the thermotherapy device in accordance with the invention to certain conditions of use, it is recommended that the outflow directions of the side and foot supply be adjustable, preferably in two directions which run perpendicular to one another or around two axes of rotation which run perpendicular to one another. Adjustment can be performed, on the one hand, via coupling the individual guides to the bed base body or a peripheral frame so that it is possible to adjust the individual guides relative to the horizontal surface. Furthermore, adjustment can take place alternatively or additionally by adjustable louvers in the area of the outflow openings of the inlet air guides. In order also to be able to match the exhaust means to altered conditions, it is recommended that the exhaust means be vertically adjustable and/or that the exhaust means be adjustable preferably around two axes of rotation which are arranged perpendicular to one another.

Fundamentally, the aforementioned oblique outflow direction can also be implemented by the side supplies and/or the foot supplies being integrated in a frame surrounding the horizontal surface that is inclined relative to the horizontal surface. The inclined frame with supplies then has not only flow engineering importance, but is also used to protect the infant located on the horizontal surface from falling down. Moreover, it goes without saying that, on the side supply and on the foot supply, there can be protective walls regardless of whether the individual supplies are arranged inclined or not. The protective walls should be detachably connectable to the respective feed, preferably should be lockable into corresponding slots. Furthermore, the protective walls can be arranged at an angle relative to vertical so that they can acquire a flow-guiding function.

In order to increase the degree of acquisition of the supplied air by the exhaust means, there can be a flap or guide flap on the exhaust means. Here, it is advantageous if the flap is pivotally mounted. Thus, it can be moved selectively into a lower position in which the flap develops a flow-guiding action or into an upper position in which unhampered access to the horizontal surface is ensured. The flap should extend at least in areas over the length of the head side and at least in areas over the length of the horizontal surface which the base body of the exhaust means overhangs to ensure a favorable flow-guiding action in the lower position. Here, it can be advantageous if the flap, in the lower position, extends both over the entire width of the head side or the foot side as well as over the entire length of the horizontal surfaces overhung by the base body of the exhaust means. In this case, the space requirement for pivoting of the flap is, however, correspondingly greater. In order to preclude accidentally falling down and the associated danger potential, the flap can be supported such that it remains in almost any position between the lower and the upper position without separate manual attachment. In addition to the flow-guiding function, the flap can be used to protect an infant located on the horizontal surface against unwanted effects from the outside. Basically, it is preferred that the flap is made from a transparent plastic at least in areas. It goes without saying that, fundamentally, the flap can also be provided elsewhere on the thermotherapy device. It is also possible to provide a retractable, insertable or comparable device instead of a pivoting flap.

Favorable flow-engineering effects for setting of the desired microclimate can otherwise be achieved in that the supplied air emerges, not parallel, but in different directions, from the exit openings of a supply. In order to produce such a diverging flow profile, the exit openings can be aligned in different directions. In this way, for example, a radial outflow can be achieved. Alternatively or additionally to the aforementioned alignment of the exit openings, there can also be a guide device with which the desired flow profile of the air emerging from the supply can be adjusted. This can be recommended if the guide device has flow-guiding louvers or the like.

As already initially mentioned, in conjunction with a thermotherapy device, it is necessary to make available a certain microclimate. To maintain the microclimate, the supplied air should have a temperature between 37° C. (98.6° F.) and 41° C. (105.8° F.), preferably roughly 39° C. (102.2° F.). The relative humidity should be between 80% and 90%, and preferably, roughly 85%, as is established in DIN EN 60601-2-19. So that energy use is as low as possible, for operation of the device in accordance with the invention, the intake air should be filtered and/or thermodynamically conditioned and supplied again to the supply means. Structurally in this connection, there is a means for conditioning the air which is coupled to the exhaust means and which preferably has a filter means, a humidifying means and a heating means. In this connection, it is recommended that the means for conditioning the air be made such that the temperature and/or the humidity of the air can be adjusted. Furthermore, the feed rate of the air should be adjustable in order to consider the effect of cross flows which can arise by superimposed room air flows. This is especially important in spaces in which climate-control systems have been installed.

Furthermore, there should be at least one connection possibility for feed of other gases. In this way, the invention makes it possible to enrich the inlet air with (medical) gases such as, for example, oxygen in order to advantageously adjust the composition of the respired air in the region of the "flow tent" with respect to medical aspects.

The exhaust or acquisition means used to intake the rising thermal air flow should have a high degree of acquisition in order to be able to capture and re-use portions of the supplied air and the energy contained therein which are as large as possible. Therefore, it is recommended that a swirl hood be used as the exhaust means. Preferably, in this connection, it is otherwise such that the front wall on the head side is part of the swirl hood. The front wall thus passes into the swirl hood and has a flow-guiding action.

Other features of the invention will become apparent from the following description of exemplary embodiments in conjunction with the accompanying drawings.

DETAILED DESCRIPTION OF THE INVENTION

Figure 1:
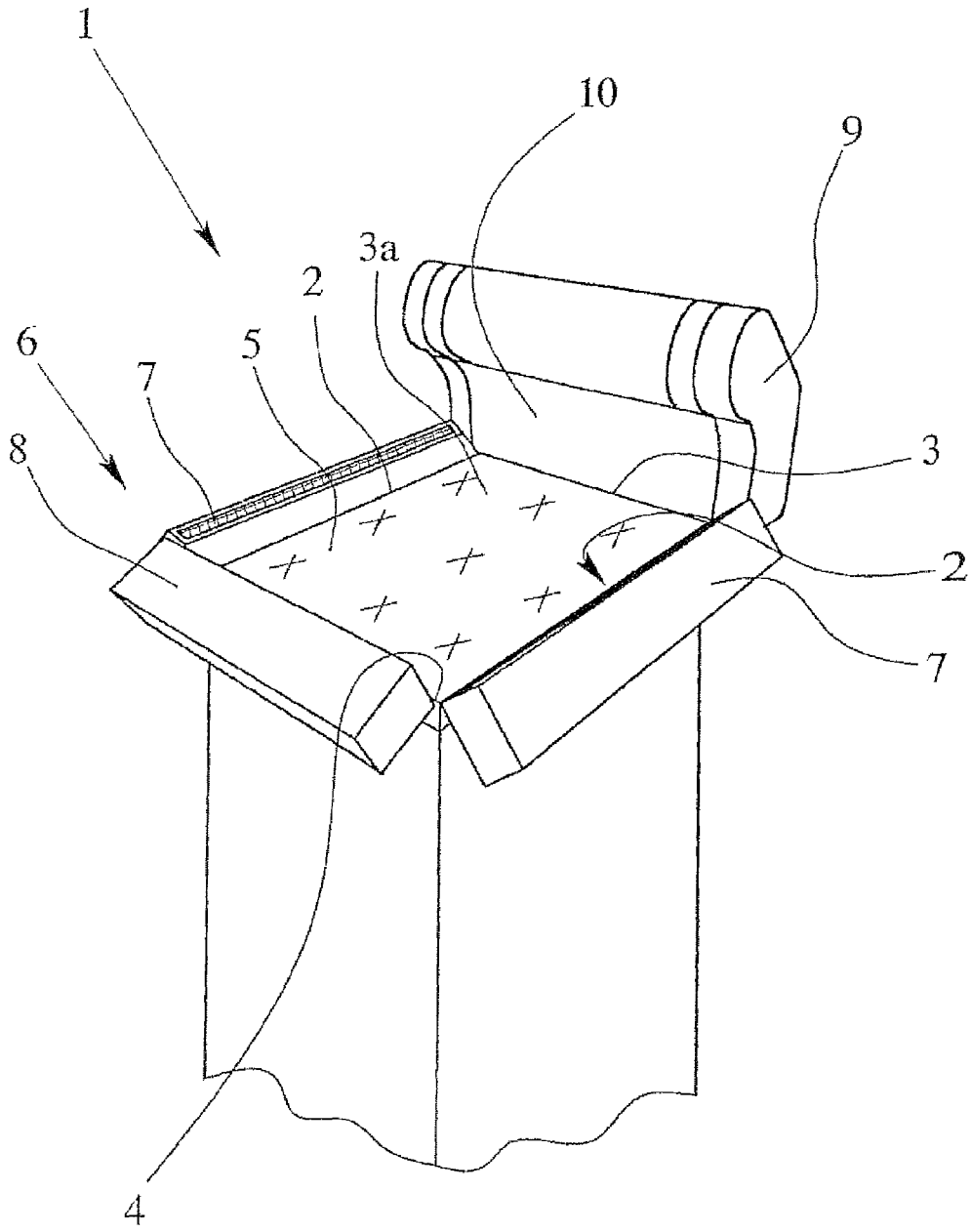
FIG. 1 shows a perspective view of a first preferred embodiment of the thermotherapy device in accordance with the invention.
Figure 2:
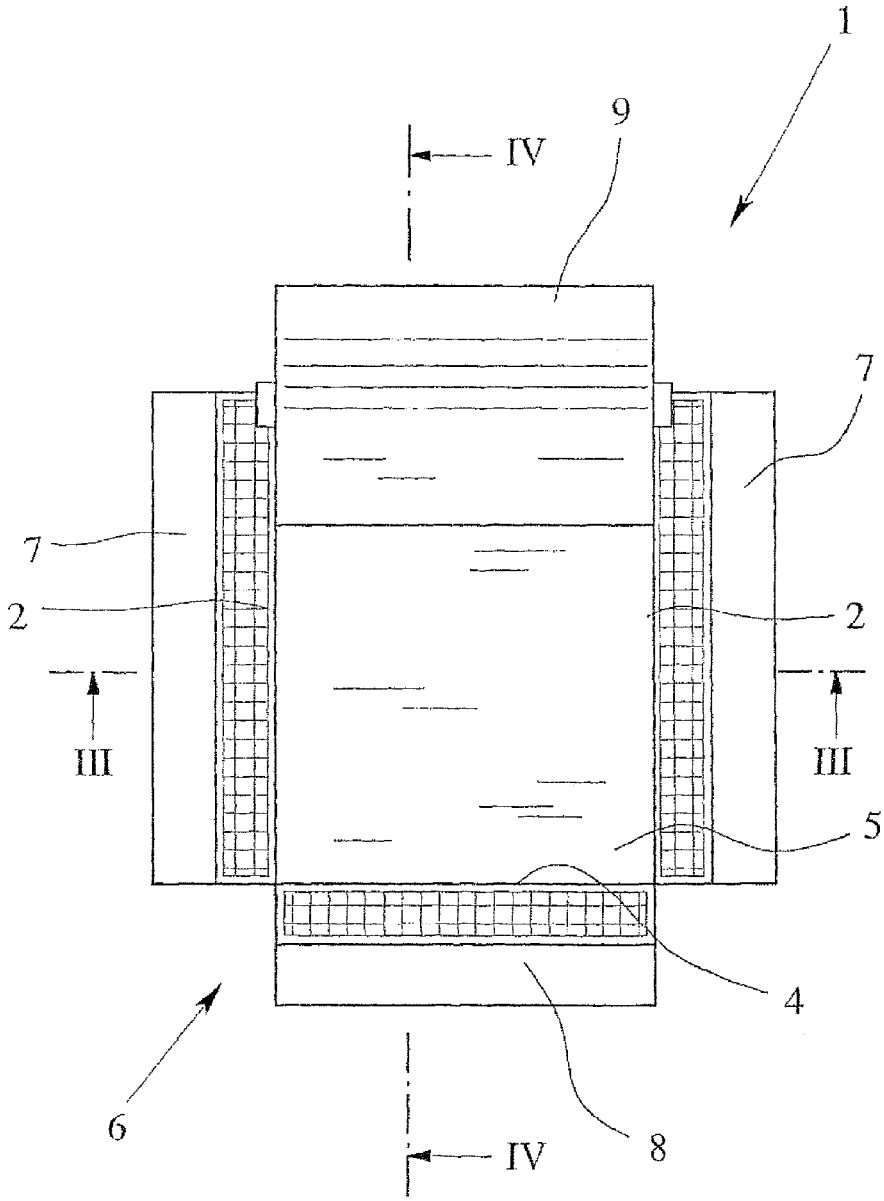
FIG. 2 shows a top view of the thermotherapy device from FIG. 1.
Figure 3:
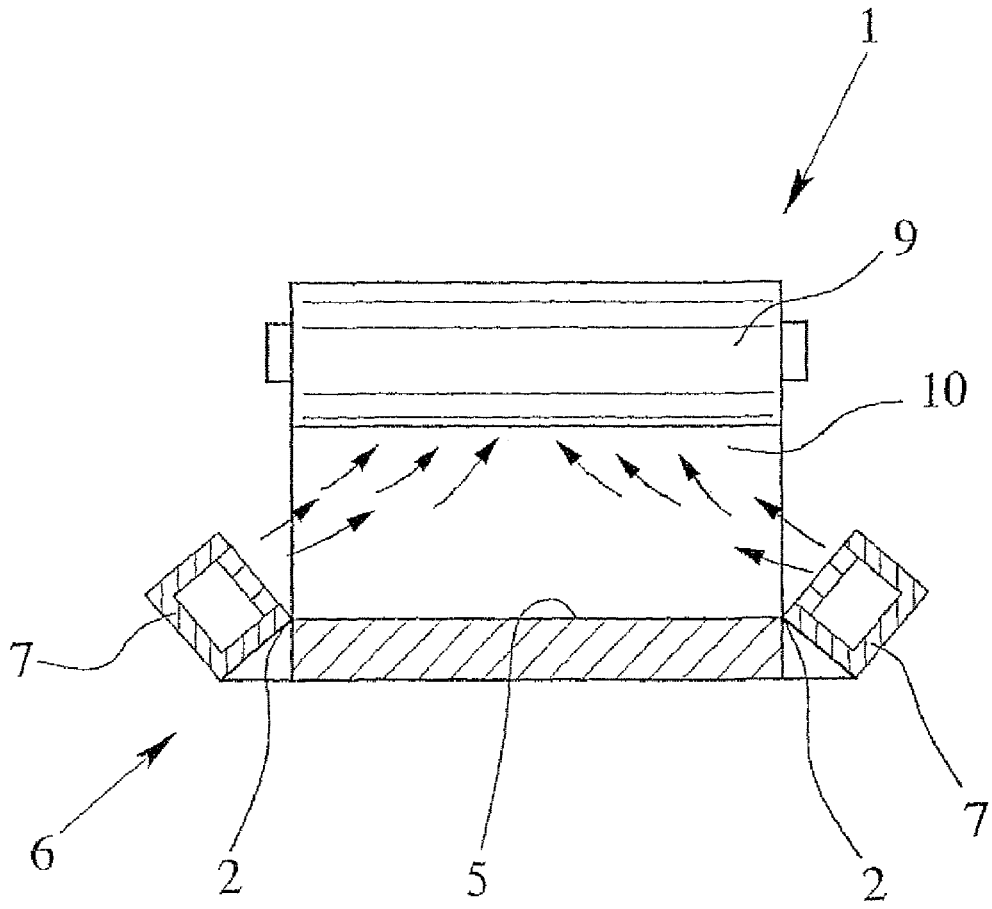
FIG. 3 shows a cross-sectional view of the thermotherapy device from FIG. 1 taken along line III-III FIG. 2.
Figure 4:
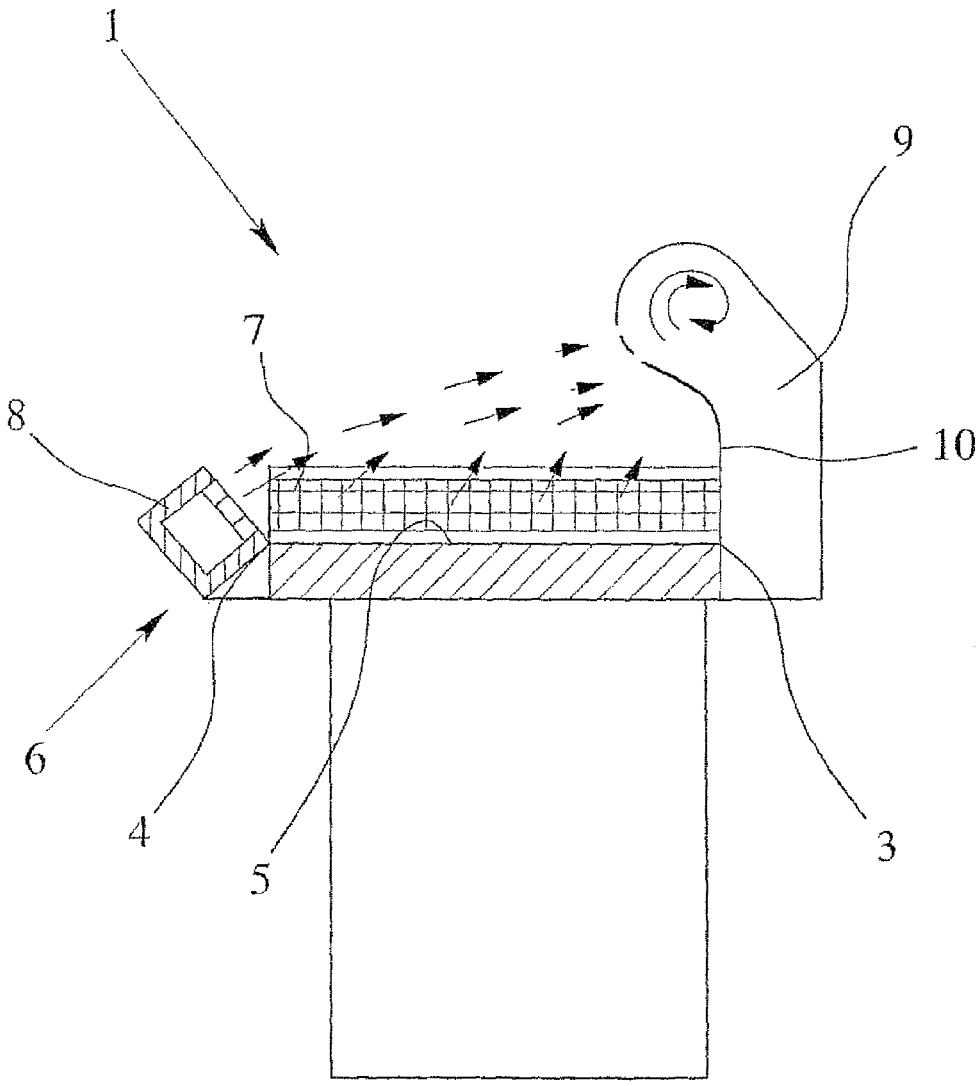
FIG. 4 shows a cross-sectional view of the thermotherapy device from FIG. 1 taken along line IV-IV in FIG. 2.

FIGS. 1 to 4 show a thermotherapy device 1 with a horizontal surface 5 bordered by two lengthwise sides 2, a head side 3 and a foot side 4. The head side 3 is bordered by the head area 3*a* of the horizontal surface 5, the patient intended for thermal therapy lying preferably on the horizontal surface 5 such that at least the head of the patient rests on the head region 3*a*. This is however not critical, the head of the patient also being able to rest basically also underneath the head area; this can be the case especially for newborns. It is important that there is intake of the supplied air only above the head side 3 and/or the head region 3*a*.

The thermotherapy device 1 has an upwardly directed supply means 6 for supply of warm, moist air on three sides of the horizontal surface 5, with a side supply 7 in the area of each of the two lengthwise sides 2 and a foot supply 8 in the area of the foot side 4. It is pointed out that this embodiment is simply a schematic representation. A description of supply lines and the like has been omitted. The supply means 6 can be easily integrated into a U-shaped or closed frame which surrounds the horizontal surface 5; this is not shown in particular. Furthermore, above the head side 3, there is an exhaust means 9 for exhausting the supplied air. With this, the illustrated thermotherapy device 1 enables thermotherapy in which warm moist air is blown upwardly only from the lengthwise sides 2 and the foot side 4 and is exhausted from above at the head end. In this way, a given microclimate can be formed above the horizontal surface 5.

Furthermore, in the illustrated thermotherapy device 1, there is a front wall 10 which is connected to the exhaust means 9. Here, the front wall 10 extends at least essentially over the length of the head side 3. In this way, in the illustrated thermotherapy device 1, and during thermotherapy, bulkheading of the head side 3 is achieved.

While in the illustrated thermotherapy device 1, the side supplies 7 extend over the full length of the lengthwise sides 2, the foot supply 8 extends over the full length of the foot side 4 and the exhaust means 9 extends over the full length of the head side 3, basically, it is also possible for each of the supplies 7, 8 to extend in exactly the same manner as the exhaust means 9 only over part of the corresponding sides 2, 3, 4, when, in this way, sufficient flow over the horizontal surface 5 is achieved by the supplied air. The exhaust means 9 is, moreover, arranged over the horizontal surface 5 such that the exhaust means 9 overhangs the horizontal surface 5 from the head side 3 so that an advantageous air flow is formed. Thus, it is not established how far the exhaust means 9 overhangs the horizontal surface 5. In order to ensure sufficient accessibility of the horizontal surface 5, the exhaust means 9 should overhang the horizontal surface 5 at most by ⅔ of the length of the horizontal surface 5.

The direction in which the air emerges from the side supplies 7 and the foot supply 8 is at an angle from 0 to 90° to the vertical. In this connection, the two side supplies 7 are inclined relative to one another and the outflow direction of the foot supply 8 is directed obliquely toward the head side 3. This arrangement of the outflow directions and otherwise the induction of individual flows yield a contraction of the supplied air in the upper region.

In the thermotherapy device 1 shown in FIGS. 1 to 4, the exhaust means 9 is located at a distance above the horizontal surface 5 which is smaller than the width of the horizontal surface 5. Moreover, the side supplies 7 and the foot supply 8 are arranged inclined with respect to the horizontal surface 5. Not shown is the fact that the incident flow directions of the side supplies 7 and the foot supply 8 as well as the exhaust means 9 can be moved around two axes of rotation which run perpendicular to one another and thus in different directions. The exhaust means 9 is also vertically adjustable; this is however not shown individually.

Figure 5:
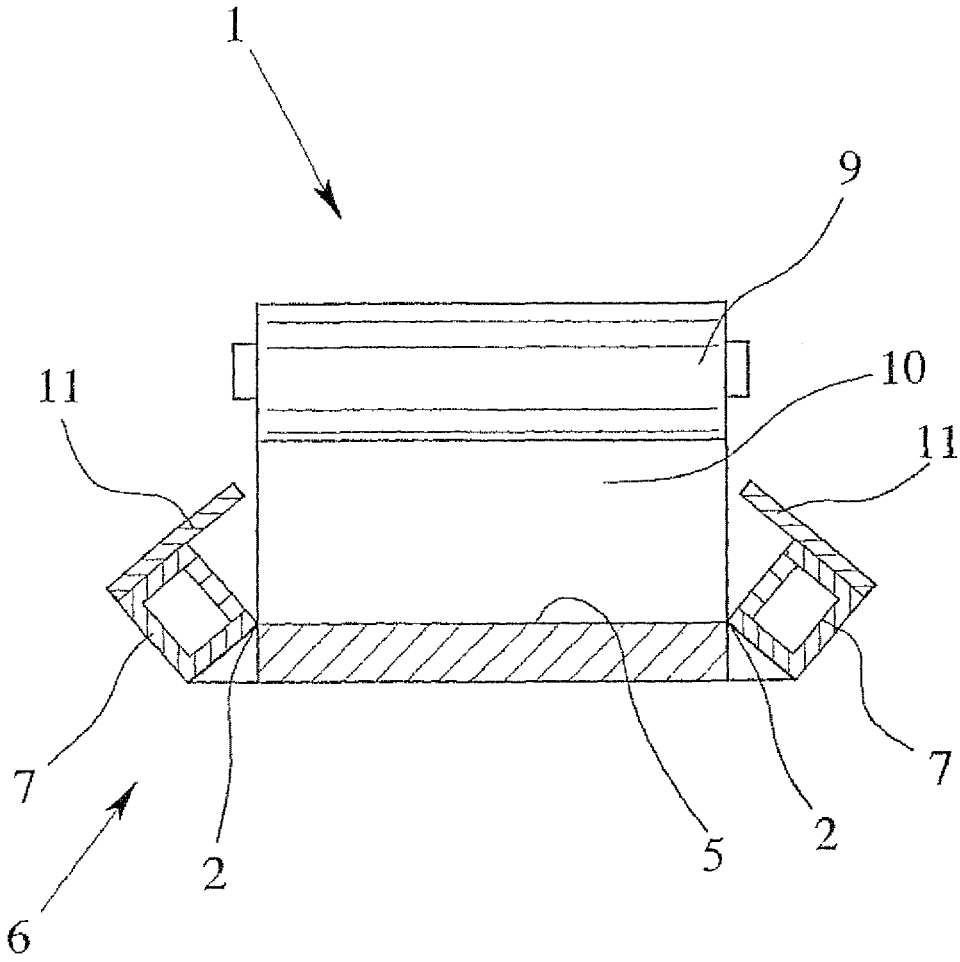
FIG. 5 is a cross-sectional view of a second preferred embodiment of the thermotherapy device in accordance with the invention in a view corresponding to that of FIG. 3.
Figure 6:
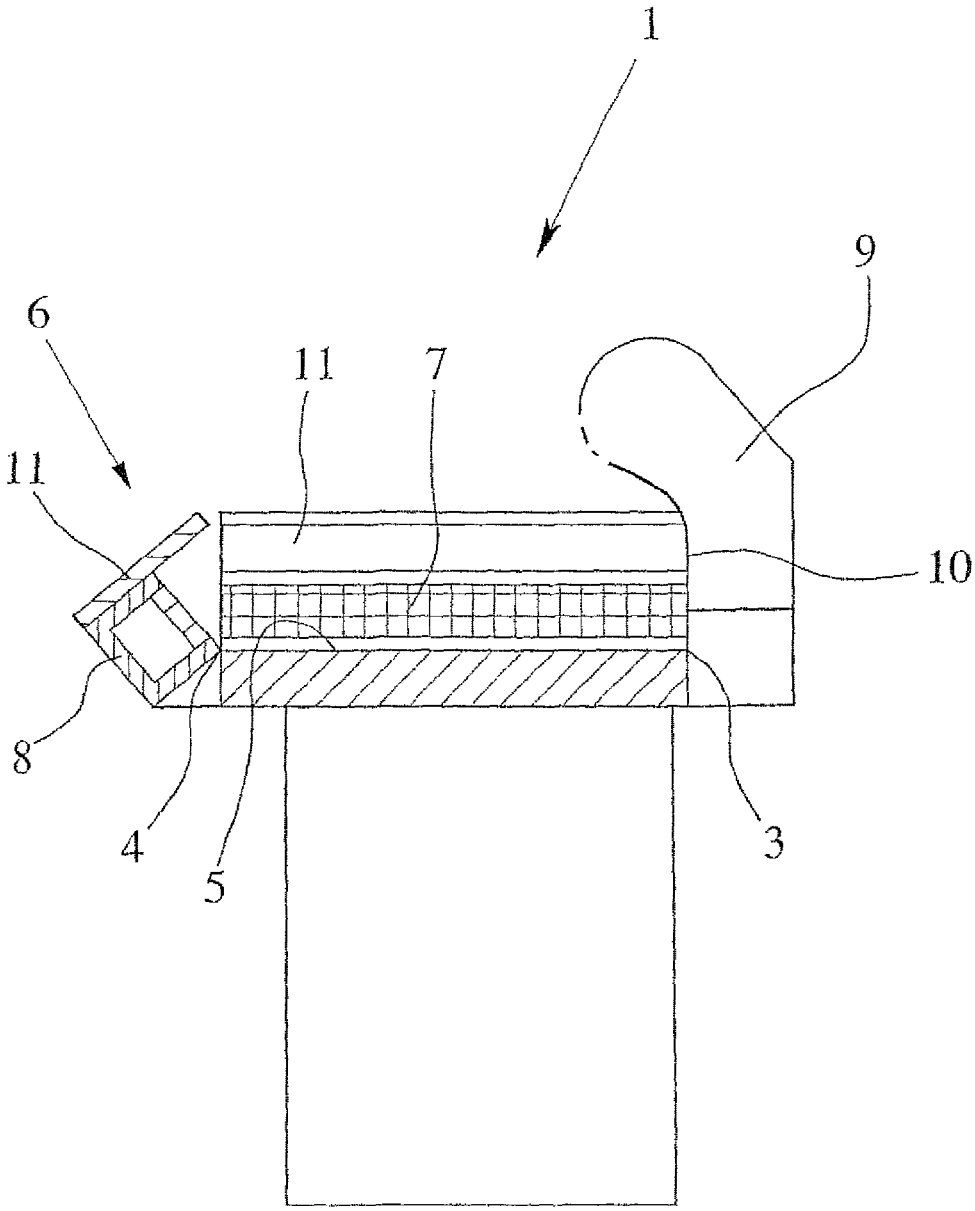
FIG. 6 is cross-sectional view of the thermotherapy device of FIG. 5 in a view corresponding to that of FIG. 4.

FIGS. 5 and 6 show a thermotherapy device 1 in which there are protective walls 11 on the side supplies 7 and the foot supply 8. In this connection, the individual protective walls 11 are detachably connected to the respective supplies 7, 8. So that the protective walls 11 can perform a flow-routing function, the protective walls 11 are arranged here at an angle to the vertical. The protective walls 11 of the side supplies 7 are pointed obliquely at one another, while the protective wall 11 of the foot supply 8 is pointed obliquely in the direction toward the head side 3. It has been pointed out that the representation of the protective walls is simply schematic. It goes without saying that they can, of course, also be mounted in another form on the supplies 7, 8 or on the peripheral frame which is not shown individually.

Figure 7:
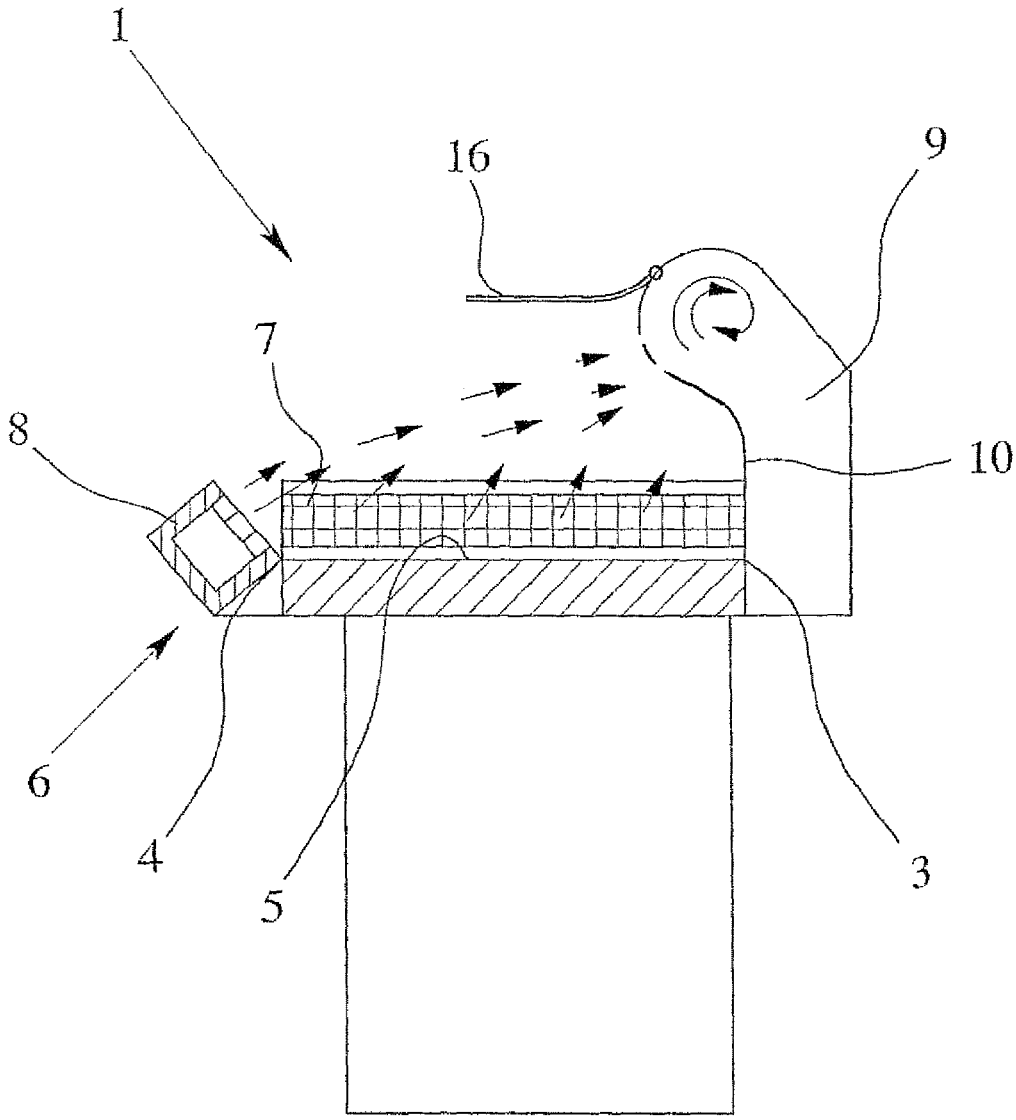
FIG. 7 is a cross-sectional view of a third preferred embodiment of the thermotherapy device in accordance with the invention in a view corresponding to that of FIG. 4, FIGS. 8*a* & 8*b* are cross-sectional views of two preferred side supplies.

FIG. 7 shows a thermotherapy device 1 in which there is a flap 16 on the base body of the exhaust means 9 which extends in areas over the length of the head side 3 and which is pivotally supported. The flap 16 is located in the lower position in which it extends over part of the length of the horizontal surface 5. In this lower position, the flap 16, as shown schematically in FIG. 7, performs a flow-routing function. It is not shown in particular that the flap 16 can be swung out of the lower position, in this figure clockwise, into an upper position which clears access to the horizontal surface 5. Otherwise, the flap 16 can, if necessary, be pivoted farther down, in this figure counterclockwise, overly low pivoting not being feasible since it not only blocks the intake opening of the exhaust means 9, but also adversely affects the handling of the infant on the horizontal surface 5.

Figure 8A:
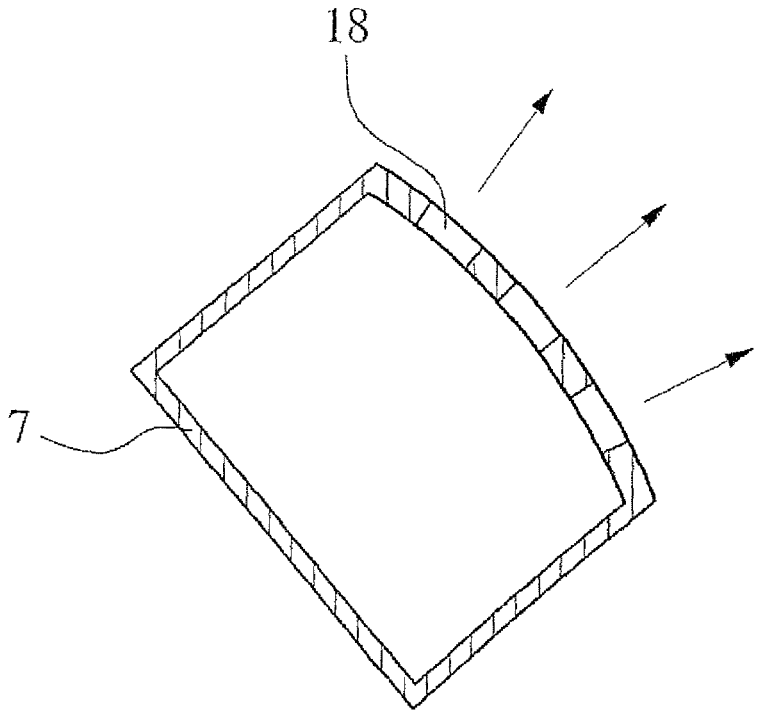
Figure 8B:
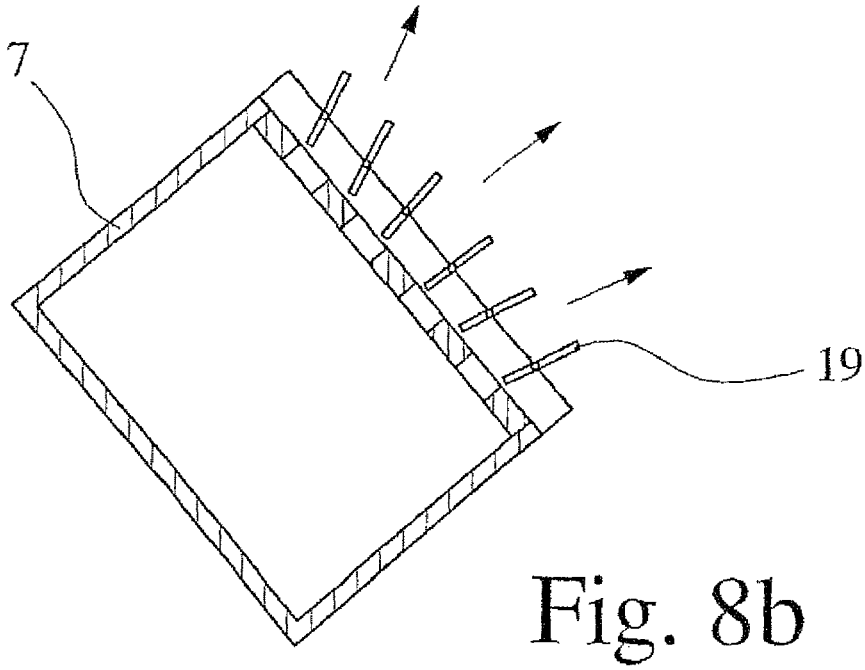

FIGS. 8*a* & 8*b* show preferred embodiments of a side supply 7 which enables a diverging outflow of the supplied air. Here, the exit openings 18 in FIG. 8*a* have different openings so that a radial flow profile is obtained. This flow profile, as shown in FIG. 8*b*, can also be achieved by a flow-routing guide means 19 which is provided in addition or alternatively. It is not shown in particular that other flow profiles can also be produced by the alignment of the exit openings 18 or the use of a guide means 19. It goes without saying that the versions of the side supplies 7 shown in FIGS. 8*a* & 8*b* can also be provided in the same way for the foot supply 8.

Figure 9:
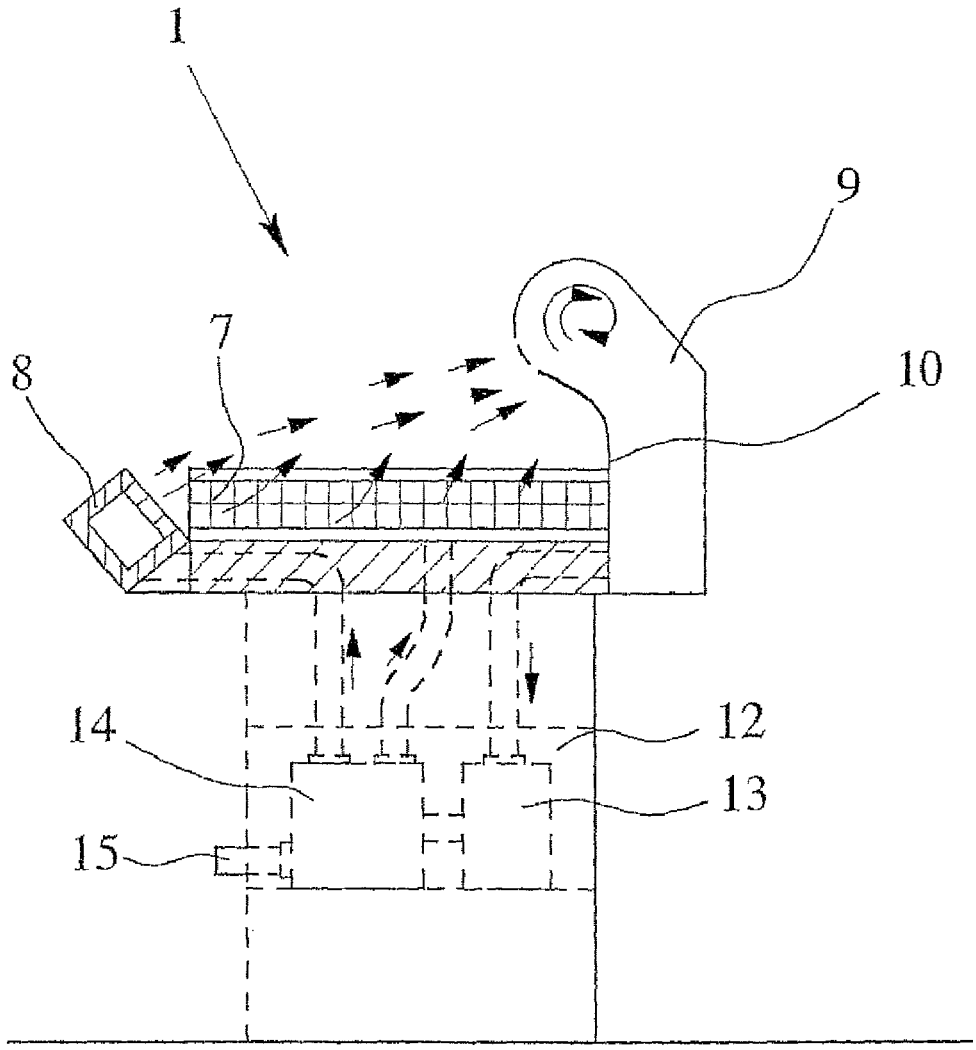
FIG. 9 is a schematic cross-sectional view of a fourth preferred embodiment of the thermotherapy device in accordance with the invention in a view corresponding to that of FIG. 3.

In the thermotherapy device 1 shown in FIG. 9, the schematically shown air conditioning means 12 is coupled to the exhaust means 9. The air conditioning means 12 is shown here as a separate system. However, integration into the device 1 is also easily possible. Furthermore, not shown is a corresponding fan via which the supplied air is exhausted which is connected to the exhaust means 9. The fan can also be integrated into the device 1. The air conditioning means 12 has a humidification means 13 and a heating means 14 so that in addition to the supply speed via the fan, the temperature and humidity of the air can be set in the desired manner. In order to be able to add other gases to the air before it is supplied in order to establish the desired atmosphere over the horizontal surface 5, the air conditioning means 12 has a corresponding connection 15. Here, it is fundamentally also possible for there to be a connection 15 in the area of the supplies 7, 8 and for other gases to be added, viewed in the air flow direction, between the air conditioning means 12 and the supplies 7, 8.

The thermotherapy devices 1 shown in FIGS. 1 to 7 and 9 are otherwise those in which the exhaust means 9 is a swirl hood, the swirl hood 9 passing into the front wall 10.

Figure 10:
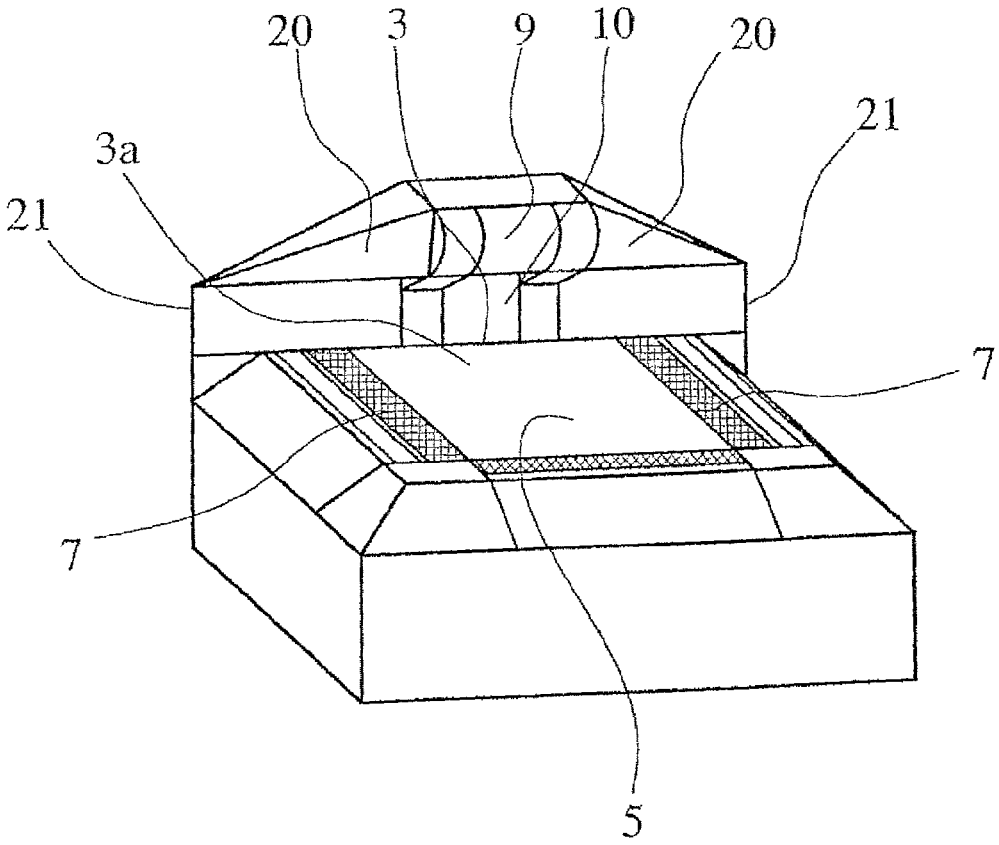
FIG. 10 is a perspective view of another embodiment of a thermotherapy device in accordance with the invention.

FIG. 10 shows another embodiment of a thermotherapy device 1 which corresponds essentially to the thermotherapy device 1 shown in FIG. 1. However, in contrast the device of FIG. 1, in the thermotherapy device 1 shown in FIG. 10, the air intake does not take place over the complete length of the head side 3, but simply over the middle area of the horizontal surface 5 which extends on either side of the lengthwise center axis of the horizontal surface 5. In this way, it is possible for the intake of unwanted air on the two ends of the exhaust means 9, which can likewise be a swirl hood in the embodiment shown in FIG. 10, to be largely prevented and the available air flow to be concentrated in the center of the thermal convection flow. Moreover, the embodiment shown in FIG. 10 has the advantage that at least limited access to the patient from the head side 3 is also possible.

Furthermore, in the embodiment shown in FIG. 10, it is provided that the front wall 10 is an integral component of the exhaust means 9, so that the front wall 10 assumes a flow-guiding function. If the exhaust means 9 is a swirl hood, the front wall 10 can pass into the swirl hood, the front wall 10 deflecting the intake flow in the direction to the jacket of the swirl hood. Here, it is provided that the air is simply taken in above the head side 3 and/or the head area 3*a* bordering the head side 3. Accordingly, the exhaust means 9 is located above the head side 3 and the head area 3*a* and overhangs the horizontal surface 5. The exhaust means 9 extends in the lengthwise direction over part of the width of the horizontal surface 5.

Moreover, it is provided that, laterally on the exhaust means, there are guide elements 20. The guide elements 20 extend from the side walls of the exhaust means 9 and extend beyond the side supplies 7 as far as the lateral front sides 21 of the front wall 10. The guide elements 20 overhang the horizontal surface 5 above the head area 3*a* in the manner of a jacket, and a collar opening of the guide element 20 can be made to taper in the direction toward the lateral front side 21 of the front wall 10. The opening width of the collar opening bordering the exhaust means 9 can correspond essentially to the width of the intake opening of the exhaust means 9 and can continuously decrease in the direction to the side supplies, so that the guide element 20 has a triangular base surface. The front wall 10 can otherwise be aligned in the region of the exhaust means 9 with the upper jacket surface of the exhaust means 9 and can be made beveled in the direction to the lateral front sides 21. The front wall 10 can be an integral component of the guide element 20. As a result, the degree of thermal acquisition of the exhaust means 9 is further improved.

It is not shown in particular that the air flow taken in can be divided into two component flows, preferably, the component flows being supplied with a different temperature and/or with a different speed, especially via different exit areas of the horizontal surface 5. Air supply can take place via the side supplies 7 and/or the foot supply 8 such that, on the one hand, the temperature of the inner region of the horizontal surface 5 decreases to the outside and on the other hand the exit speed also decreases from the inside to the outside. The latter reduces the shear flows between the individual air jets and reduces the induction, and thus, the admixture of ambient air. However, basically, it is also possible to break the air down into several component flows and to supply the air with respect to temperature and exit speed staggered accordingly over different exit surfaces of the horizontal surface 5. The exit surfaces can have honeycomb, directional baffle plates in order to produce a certain flow profile.

The aforementioned features of the embodiments shown in FIGS. 1 to 10 can be combined if necessary, i.e., individually or in any combination, even if this is not mentioned and described specifically.

What is claimed is:

1. Thermotherapy device for an infant, comprising:

a horizontal surface for support of an infant lying thereon, the horizontal surface having two lengthwise sides, a foot side, and a head side, a three-sided supply means for upwardly directing a supply of warm moist air, said supply means having a side supply bordering each of the lengthwise sides of the horizontal surface and a foot side supply bordering the foot side of the horizontal surface, and an exhaust means for exhausting the supplied air, the exhaust means being located at least above a head area of the horizontal surface which borders the head side of the horizontal surface, wherein incident flow directions of the flow supplies are adjustable around two axes of rotation which run perpendicular to one another.

2. Thermotherapy device as claimed in claim 1, wherein the exhaust means overhangs the horizontal surface by an amount that is at most ⅔ of the length of the horizontal surface from the head side.

3. Thermotherapy device as claimed in claim 1, wherein the exhaust means extends transversely to a lengthwise direction of the horizontal surface at least in areas above the head side.

4. Thermotherapy device as claimed in claim 1, wherein the exhaust means extends only over a middle region of the horizontal surface.

5. Thermotherapy device as claimed in claim 1, wherein the exhaust means has a length that is smaller than a width of the horizontal surface.

6. Thermotherapy device as claimed in claim 1, wherein a front wall is provided on the head side, wherein the exhaust means is connected to the front wall.

7. Thermotherapy device as claimed in claim 6, wherein the front wall extends at least essentially over the full length of the head side, wherein each side supply extends at least essentially over the full length of a respective lengthwise side, wherein the foot supply extends at least essentially over the length of the foot side and wherein the exhaust means extends at least essentially over the full length of the head side.

8. Thermotherapy device as claimed in claim 1, wherein the exhaust means has at least one guide element which at least partially overhangs the horizontal surface.

9. Thermotherapy device as claimed in claim 8, wherein the at least one guide element extends along a front side of the exhaust means as far as a lengthwise side.

10. Thermotherapy device as claimed in claim 1, wherein outflow directions of the side supplies are directed obliquely at one another at an angle between 0° and 90° relative to a vertical plane.

11. Thermotherapy device as claimed in claim 1, wherein an outflow direction of the foot supply is pointed obliquely toward the head side at an angle between 0° and 90° relative to a vertical plane.

12. Thermotherapy device as claimed in claim 1, wherein the exhaust means is located at a distance above the horizontal surface which is less than the width of the horizontal surface.

13. Thermotherapy device as claimed in claim 1, wherein the exhaust means is at least one of vertically adjustable and rotationally adjustable around two axes of rotation which run perpendicular to one another.

14. Thermotherapy device as claimed in claim 1, wherein at least one of the side supplies and the foot supply are arranged so as to be inclined relative to the horizontal surface.

15. Thermotherapy device as claimed in claim 1, further comprising a flap on a base body of the exhaust means, wherein the flap is pivotally mounted and wherein the flap extends at least in areas along the length of the head side.

16. Thermotherapy device as claimed in claim 15, wherein the flap has a lower position in which it extends at least in areas above the length of the horizontal surface and routes the supplied air toward the exhaust means.

17. Thermotherapy device as claimed in claim 1, wherein at least one of the foot supply and the side supplies has exit openings which are pointed in different directions.

18. Thermotherapy device as claimed in claim 1, further comprising a means for conditioning the air which is coupled to the exhaust means, wherein the means for conditioning the air has a humidifying means and a heating means, and wherein the means for conditioning the air is integrated into a substructure of the thermal therapy device.

19. Thermotherapy device as claimed in claim 18, wherein at least one of the temperature, the humidity, and the supply speed of the air is adjustable.

20. Thermotherapy device as claimed in claim 19, wherein the temperature is adjustable in a range between 37° C. and 41° C., and the humidity is adjustable between a relative humidity of between 80% and 90%, and a supply speed of up to 15 cm/s.

21. Thermotherapy device as claimed in claim 1, further comprising at least one connection for adding other gases.

22. Thermotherapy device as claimed in claim 1, the exhaust means comprises a swirl hood.

23. Thermotherapy device as claimed in claim 22, wherein a front wall is provided on the head side, wherein the exhaust means is connected to the front wall, wherein the front wall passes into the swirl hood and wherein the exhaust flow is deflected in a direction toward a jacket of the swirl hood by the front wall.

24. Thermotherapy device for an infant, comprising:

a horizontal surface for support of an infant lying thereon, the horizontal surface having two lengthwise sides, a foot side, and a head side, a three-sided supply means for upwardly directing a supply of warm moist air, said supply means having a side supply bordering each of the lengthwise sides of the horizontal surface and a foot side supply bordering a foot side of the horizontal surface, an exhaust means for exhausting the supplied air, the exhaust means being located at least above a head area of the horizontal surface which borders the head side of the horizontal surface, and at least one flow-routing member on at least one of the foot supply and the side supplies for routing air exiting the respective supply.

25. Thermotherapy device as claimed in claim 24, wherein the flow-routing member on at least one of the foot supply and the side supplies is a protective wall.

26. Thermotherapy device as claimed in claim 25, wherein each protective wall is detachably connected to the respective supply.

27. Thermotherapy device as claimed in claim 25, wherein each protective wall is located at an angle relative to vertical so as to route the supplied air toward the exhaust means.

28. Thermotherapy device for an infant, comprising:

a horizontal surface for support of an infant lying thereon, the horizontal surface having two lengthwise sides, a foot side, and a head side, a three-sided supply means for upwardly directing a supply of warm moist air, said supply means having a side supply bordering each of the lengthwise sides of the horizontal surface and a foot side supply bordering a foot side of the horizontal surface, and an exhaust means for exhausting the supplied air, the exhaust means being located at least above a head area of the horizontal surface which borders the head side of the horizontal surface, wherein said at least one of the foot supply and the side supplies has a plurality of exit openings and wherein at least one flow-routing member is provided which comprises a respective guide plate for guiding air flowing out of each of said exit openings.

* * * * *